US005563502A

United States Patent [19]

Akioka et al.

[11] Patent Number: 5,563,502

[45] Date of Patent: Oct. 8, 1996

[54] CONSTANT VOLTAGE GENERATION CIRCUIT

[75] Inventors: Takashi Akioka, Hitachi; Yutaka Kobayashi, Katsuta, both of Japan

[73] Assignee: Hitachi, Ltd., Tokyo, Japan

[21] Appl. No.: 20,809

[22] Filed: Feb. 22, 1993

[30] Foreign Application Priority Data

Feb. 20, 1992 [JP] Japan ..... 4-033119

[51] Int. Cl.[6] ..... G05F 3/16; G05F 3/20

[52] U.S. Cl. ..... 323/313; 323/315

[58] Field of Search ..... 323/312, 313, 323/314, 315, 907; 330/257, 288; 327/530, 538, 540, 544

[56] References Cited

U.S. PATENT DOCUMENTS

| | | | |
|---|---|---|---|
| 4,258,311 | 3/1981 | Tokuda et al. | 323/313 |
| 5,180,995 | 1/1993 | Hayashi et al. | 331/57 |
| 5,278,491 | 1/1994 | Nitta et al. | 323/313 |
| 5,430,395 | 7/1995 | Ichimaru | 323/312 |

OTHER PUBLICATIONS

"Analysis and Design of Analog Integrated Circuits", published by John Wily and Sons, Inc., New York, 1984.

"VLSI Design Techniques for Analog and Digital Circuits", by R. L. Geiger et al., McGraw-Hill, 1980.

"Performance Limitations of Low-Voltage Regulators Using only n-p-n Transistors", Thomas C. Banwell, IEEE Journal of Solid-State-Circuits, vol. 26, No. 1, Jan. 1991.

"Design Techniques for IC Voltage Regulators without n-p-n Transistors", Mark S. Birrittella etal, IEEE Journal of Solid-State Circuits, vol. sc-22, No. 1, Feb. 1987.

*Primary Examiner*—Matthew V. Nguyen

*Attorney, Agent, or Firm*—Antonelli, Terry, Stout & Kraus

[57] ABSTRACT

A circuit for generating a constant voltage, free of dependence on temperature changes, by adding a voltage having positive temperature dependence to a voltage having negative temperature dependence. A current generation circuit for generating a current having positive temperature dependence is connected with an element for converting this current to a voltage by way of a proportional current supply circuit, for example, a current mirror circuit.

18 Claims, 17 Drawing Sheets

CONSTANT VOLTAGE GENERATION CIRCUIT

BACKGROUND OF THE INVENTION

The present invention relates to a semiconductor integrated circuit, and more particularly to a semiconductor integrated circuit and a power supply circuit therefor which employ a constant current source circuit to reduce dependence on the power supply and dependence on the temperature characteristics of the integrated circuit.

Generally, the characteristics of integrated circuits vary depending on environmental temperature, power supply, process variations and so on. A power supply circuit may be used in order to reduce the dependence of the characteristics of the integrated circuit on these parameters. The characteristics of a particular integrated circuit are defined by a certain power supply range and a temperature range so that a power supply circuit having constant characteristics within those ranges may be provided to stabilize the characteristics of the integrated circuit.

One such example is an input/output circuit of an ECL (Emitter Coupled Logic) memory integrated circuit. The standard about the input/output of integrated circuits called 100k ECL defines an input/output range for predetermined temperature and power supply ranges and has been realized in the prior art by employing a bandgap voltage reference circuit as described below.

Conventional bandgap reference circuits are discussed in IEEE, Journal of Solid-State Circuits, VOL 26, NUMBER 1 (1991), pp 77–80; IEEE, Journal of Solid-State Circuits, VOL 22, NUMBER 1 (1987), pp 71–76; and "Analog Integrated Circuit Design Techniques, Book One", (1990, published by Baihukan) pp 270–276 (Japanese Version of "Analysis and Design of Analog Integrated Circuits" by John Wiley and Sons, Inc., New York. 1984).

The bandgap reference circuit in general has a VT generation section and a VBE generation section and utilizes that the voltages generated from these two sections have dependence of opposite polarities to each other on temperature to provide a voltage output free of the temperature dependence.

VT designates a voltage expressed by kT/q and is called "thermal voltage". The magnitude of VT has positive dependence (positive temperature coefficient) on absolute temperature T. VBE designates forward voltage generated between the base and the emitter of a bipolar transistor, and its magnitude has negative temperature dependence (negative temperature coefficient) and generally ranges from 0.6 volts to 0.8 volts. The bandgap reference circuit multiplies these two voltages VT and VBE with appropriate coefficients, respectively, and adds them to provide an output voltage free of the temperature dependence.

Generally, the voltage VT is generated by the following method. Specifically, since the difference between the VBE voltages of two bipolar transistors is proportional to VT, a voltage proportional to VT is generated by applying a resistive element with a difference voltage of VBE of the bipolar transistors.

A conventional circuit employing a bandgap reference circuit is described, for example, in IEEE, Journal of Solid-State Circuits, VOL. 22, NUMBER 1 (1987), pp 72. VBB designates a voltage reference based On VCC. This is used for a voltage reference for determining an input logic threshold level in ECL LSI's. This voltage is compensated for the temperature dependence and the power supply dependence such that the voltage value does not vary with fluctuations in temperature and power supply voltage.

However, the constant voltage generation circuit of the prior art described above has a drawback that the operation is disabled in a low voltage range.

FIG. 15 shows a conventional bandgap reference circuit. A difference voltage between base-to-emitter voltages of a pair of bipolar transistors, which present a constant collector current ratio, is proportional to a thermal voltage VT. Therefore, the difference voltage of VBE between bipolar transistors Q1 and Q2 is proportional to absolute temperature and is applied to a resistive element R2. Thus, a current proportional to absolute temperature flows through R2.

Here, bipolar transistors Q13, Q14, and resistive elements R16, R15 are circuit elements for setting a ratio of currents which flow through the bipolar transistors Q1, Q2, respectively.

Thus, a voltage proportional to absolute temperature is generated across a resistive element R14, which is added to a base-to-emitter voltage of a bipolar transistor Q8 to provide a voltage VBB free of the temperature dependence.

In the drawing, VCC designates a high voltage side power supply, and VEE a low voltage side power supply.

A resistive element R13 and a bipolar transistor Q12 set base voltages of the bipolar transistors Q13 and Q14 and also set a collector voltage of the bipolar transistor Q2.

For the ease of understanding, the circuit arrangement described above is illustrated in block form in FIG. 16.

In the drawing, an $I \propto kT/q$ generation section corresponds to a circuit portion comprising the bipolar transistors Q1, Q2 and the resistive element R2 in FIG. 15. A current ratio setting circuit block in the drawing corresponds to the bipolar transistors Q14, Q13 and the resistive elements R15, R16 in FIG. 15. A $V \propto kT/q$ generation section corresponds to R14 in FIG. 15.

Since the conventional bandgap reference circuit arranges these three circuit blocks in series between the high voltage side power supply and the low voltage side power supply, the sum of respective minimum voltages necessary to operate the three circuit blocks is required as a power supply voltage between the high voltage side power supply and the low voltage side power supply in order to enable the whole bandgap reference circuit.

SUMMARY OF THE INVENTION

It is an object of the present invention to provide a constant voltage generation circuit free of temperature dependence which is capable of operating even at a low power supply voltage with a sufficient operation margin.

The above object is achieved by a constant voltage generation circuit which adds a voltage having positive temperature dependence to a voltage having negative temperature dependence to generate a constant voltage which is not affected by varying temperature, wherein elements constituting a circuit for generating a current having positive temperature dependence on varying temperature are connected with elements constituting a circuit for converting the current into a voltage by way of a proportional current generation circuit such that currents in proportional relationship flow through the respective circuits.

The above means results in decreasing the number of elements required to be connected in series between the high voltage side power supply and the low voltage side power supply of the constant voltage generation circuit to consequently reduce the minimum power supply voltage, below which the circuit will not give good reference, thereby providing a constant voltage generation circuit operable with a lower supply voltage.

The features of the present invention other than those described above will be apparent from the following description.

DESCRIPTION OF THE PREFERRED EMBODIMENTS

A power supply circuit according to the prior art cannot ensure its operation with a margin at a low power supply voltage of about 3 volts. Although a reduction of the power supply voltage, which is currently about 5 volts, is required in order to reduce power consumption of a high speed highly integrated LSI and attend to a decrease of a device breakdown voltage due to the increasingly reduced size of devices, the above-mentioned power supply circuit according to the prior art cannot conform to the reduction of the power supply voltage to about 3 volts while maintaining an operation margin. In other words, considering voltage drop due to power supply wires and so on in an LSI chip, a new power supply operable with a lower voltage must be developed.

According to embodiments hereinafter described, an operation with a sufficient margin is ensured even at a lower power supply voltage of about 3 volts.

An embodiment of a constant voltage generation circuit according to the present invention will first be described with reference to FIG. 1.

Figure 1:
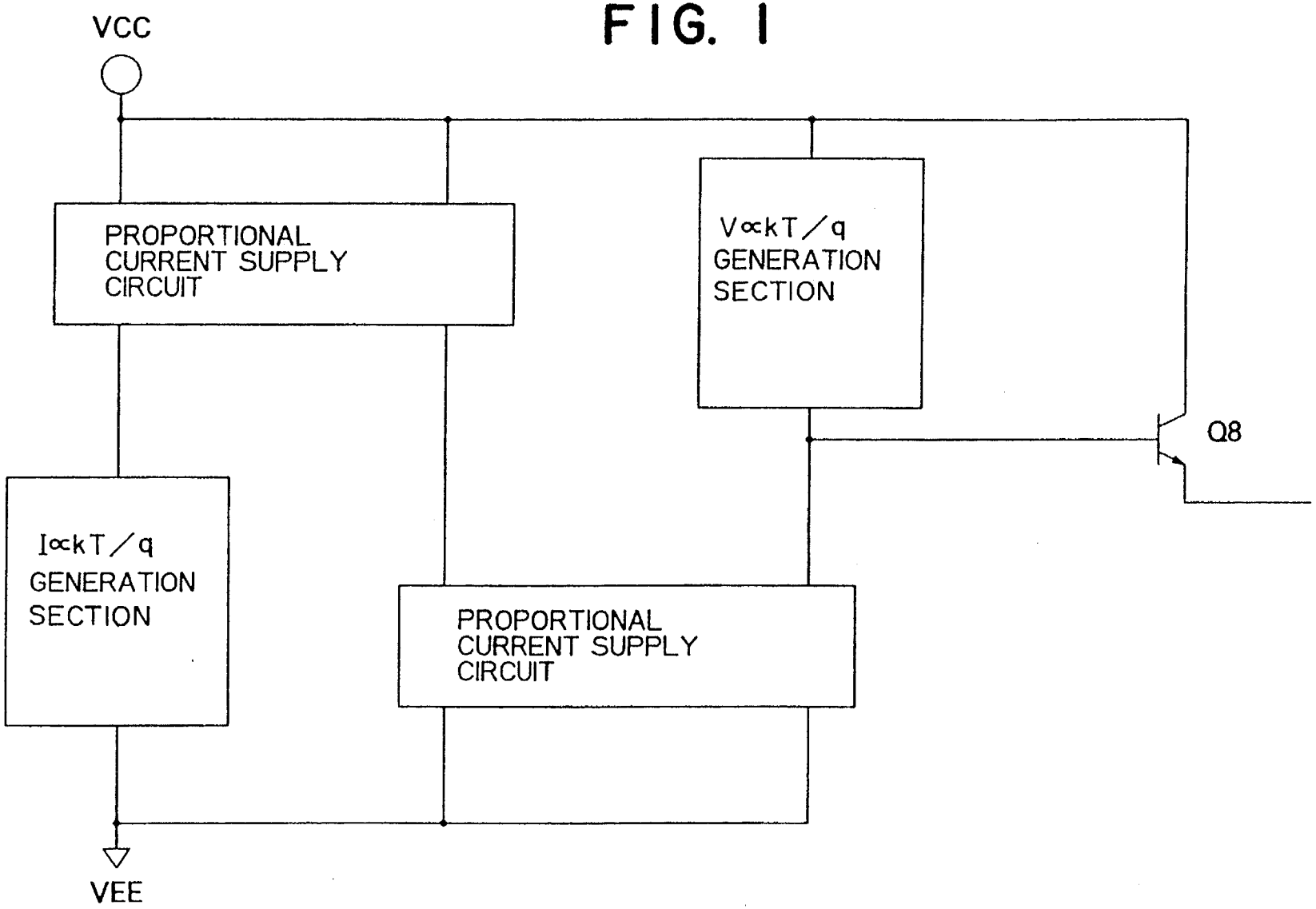
FIG. 1 is a block circuit diagram showing an embodiment of a constant voltage generation circuit according to the present invention.
Figure 16:
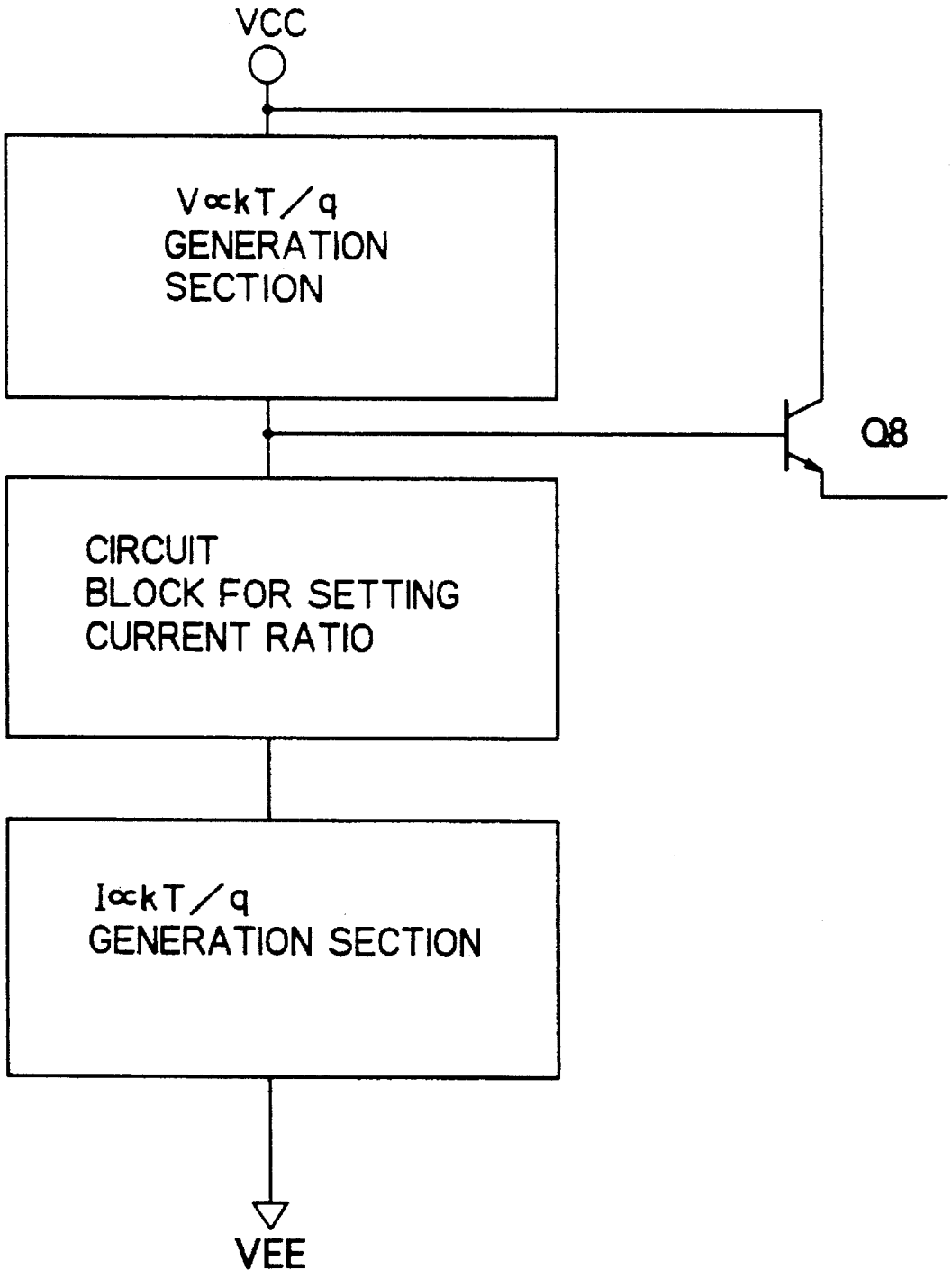
FIG. 16 PRIOR ART
FIG. 16 is a block diagram showing a conventional constant voltage circuit.

In FIG. 1, the voltage generation section and the current generation section in the conventional circuit arrangement shown in FIG. 16 are not connected in series, and instead a current proportional to kT/q, i.e., a current proportional to absolute temperature generated by a proportional current generation circuit is applied to a voltage generation section which generates a voltage represented by $V \propto kT/q$. The proportional current generation circuit is typically formed by a MOS or bipolar current mirror circuit and has a function of deriving at an output terminal thereof a current proportional to a current at an input terminal thereof.

In FIG. 1, circuit elements which are connected in series in FIG. 1 are eliminated by this arrangement, whereby a minimum power supply voltage necessary for the operation of the constant voltage generation circuit can be reduced as compared with the conventional circuit arrangement.

Incidentally, Q8 is a bipolar transistor for generating a voltage VBE.

Figure 2:
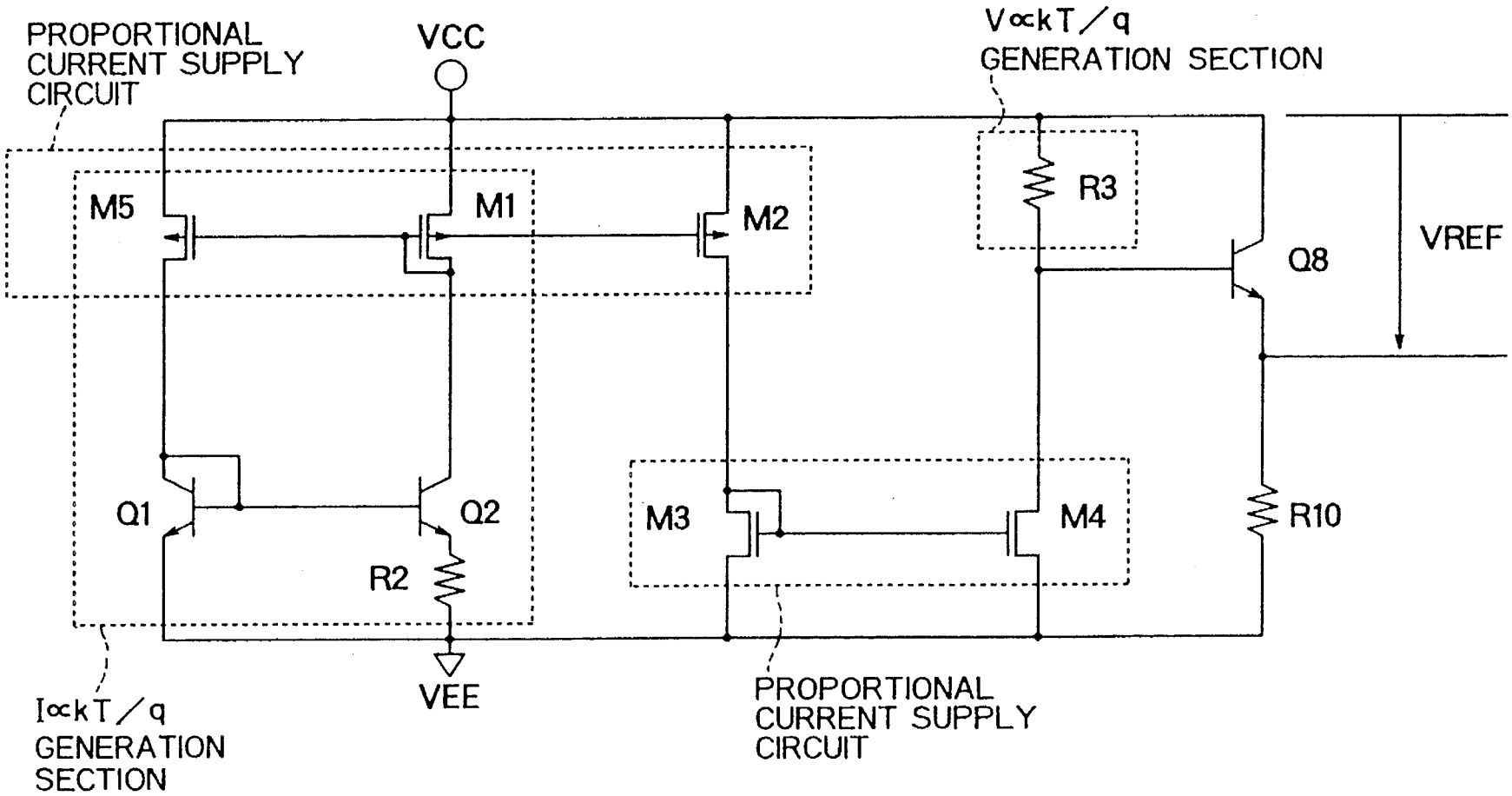
FIG. 2 is a schematic circuit diagram showing the embodiment of the constant voltage generation circuit according to an present invention.

An example of a detailed circuit arrangement of FIG. 1 is shown in FIG. 2. Each block shown in FIG. 1 corresponds to a block surrounded by a broken line and designated by the same name in FIG. 2. A difference voltage between base-to-emitter voltages VBE of respective bipolar transistors Q1 and Q2 is applied to a resistive element R2. Since MOS transistors M1, M5 have their sources connected to each other and their gates connected to each other, currents in a ratio determined by the gate lengths and gate widths of the MOS transistors M1 and M5 flow through the MOS transistors M1, M5. The ratio of collector currents of the bipolar transistors Q1 and Q2 is maintained constant by the arrangement described above. Generally, since a difference voltage between VBE's of bipolar transistors having a constant collector current ratio is proportional to a thermal voltage VT, the resistive element R2 is applied with a voltage proportional to the thermal voltage, i.e., a voltage proportional to absolute temperature. As a result, a current proportional to absolute temperature flows through the resistive element R2. Assuming that the current amplification ratio of the bipolar transistor Q1 is sufficiently high and the base current thereof is negligible, a current proportional to absolute temperature also flows through the MOS transistor M1 since the MOS transistor M1 and the resistive element R2 are connected in series. Then, through a current mirror circuit formed by the MOS transistors M1, M2 and a current mirror circuit formed by MOS transistors M3, M4, the current proportional to the thermal voltage VT flows through the MOS transistor M4. This current also flows through the resistive element R3, resulting in generating a voltage K·VT (K is a proportional constant), proportional to VT, across the resistive element R3. A base-to-emitter voltage VBE of the bipolar transistor Q8 is added to K·VT, thereby outputting at VREF a voltage free of temperature dependence based on a high voltage side power supply VCC.

Figure 3:
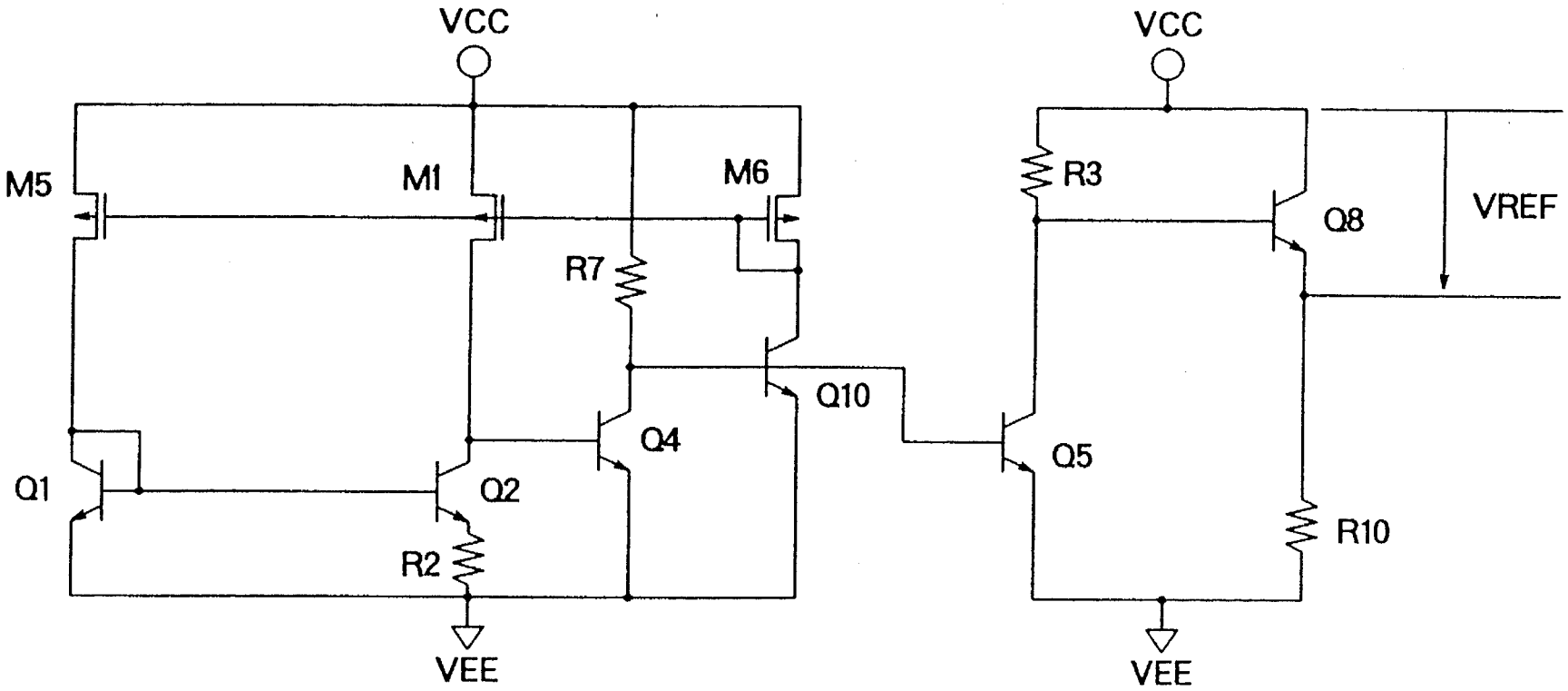
FIG. 3 is a schematic circuit diagram showing another embodiment of the constant voltage generation circuit according to the present invention.

Next, FIG. 3 shows an embodiment of a circuit arrangement, the output characteristics of which do not depend on a power supply voltage.

MOS transistors M1, M5, bipolar transistors Q1, Q2 and a resistive element R2 in FIG. 3 have similar functions to those designated the same reference numeral in FIG.2.

A bipolar transistor Q4 and a resistive element R7 constitute a feedback amplifier to amplify a voltage applied to the base of the bipolar transistor Q4 and output the amplified voltage to a point between the emitter and the collector thereof. This outputted voltage is inputted to an amplifier circuit formed by a bipolar transistor Q10 and a MOS transistor M6.

The operation of the circuit arrangement described above will be explained below. The MOS transistors M1, M5, M6 constitute a current mirror circuit, and a current proportional to that flowing through the MOS transistors M1, M5 flows through the bipolar transistor Q10. As described above, the current proportional to absolute temperature flows through the MOS transistor M1. Therefore, the current proportional to absolute temperature also flows through the bipolar transistor Q10. As the power supply voltage rises, source-to-drain voltages of the MOS transistors M1, M5 also increase, resulting in increasing the currents flowing through these MOS transistors. By this operation, the base voltage of the bipolar transistor Q4 increases to lower the base voltage of the bipolar transistor Q10 and decrease the current through the MOS transistor M6, thereby canceling the effect of the increase in the power supply current.

Since the bipolar transistor Q5 has its emitter and base connected to the correspondents of the bipolar transistor Q10, a current proportional to absolute temperature and free of power supply voltage dependence flows therethrough. This current causes the current proportional to absolute temperature to flow through R3, and accordingly a voltage proportional thereto to be generated across R3. This voltage is added to VBE of the bipolar transistor Q8 to derive an output voltage VREF. It will be appreciated that this output voltage VREF is free of temperature dependence and power supply voltage dependence.

A minimum power supply voltage necessary to operate the circuit of the present embodiment is described in the following manner.

Since the MOS transistor M6 needs to be used in a saturation region of the MOS transistor, a voltage of about 1 volt is required between its source and the drain. This value varies depending on the characteristics of each MOS transistor. For example, if a depression MOS transistor is used, this value can be more reduced. Next, a voltage of about 0.8 volts is required so as not to saturate the bipolar transistor Q10. This value also varies depending on the characteristics of the bipolar transistor and the setting of a current value. Thus, the circuit of the present embodiment operates with a total power supply voltage of about 1.8 volts.

The effect of the present embodiment is to provide a power supply circuit suitable to generate an input threshold value of an ECL input buffer which is free of the power supply voltage dependence and the temperature dependence even at a low voltage of about 1.8 volts.

A minimum operable power supply voltage, i.e., a minimum power supply voltage below which the circuit Will not give good reference, required for the circuit of this embodiment is the sum of respective voltages necessary to operate the MOS transistor M1, the bipolar transistor Q1 and the resistive element R2. Since the voltage required to the bipolar transistor Q1 and the resistive element R2 is about 0.8 volts, while the voltage required to the MOS transistor M1 is about 1 volt, the circuit is operable with a lower power supply voltage of about 1.8 volts.

Next, explanation will be given of an example in which the present invention is applied to an ECL (Emitter Coupled Logic) output buffer of a semiconductor memory device.

Figure 17:
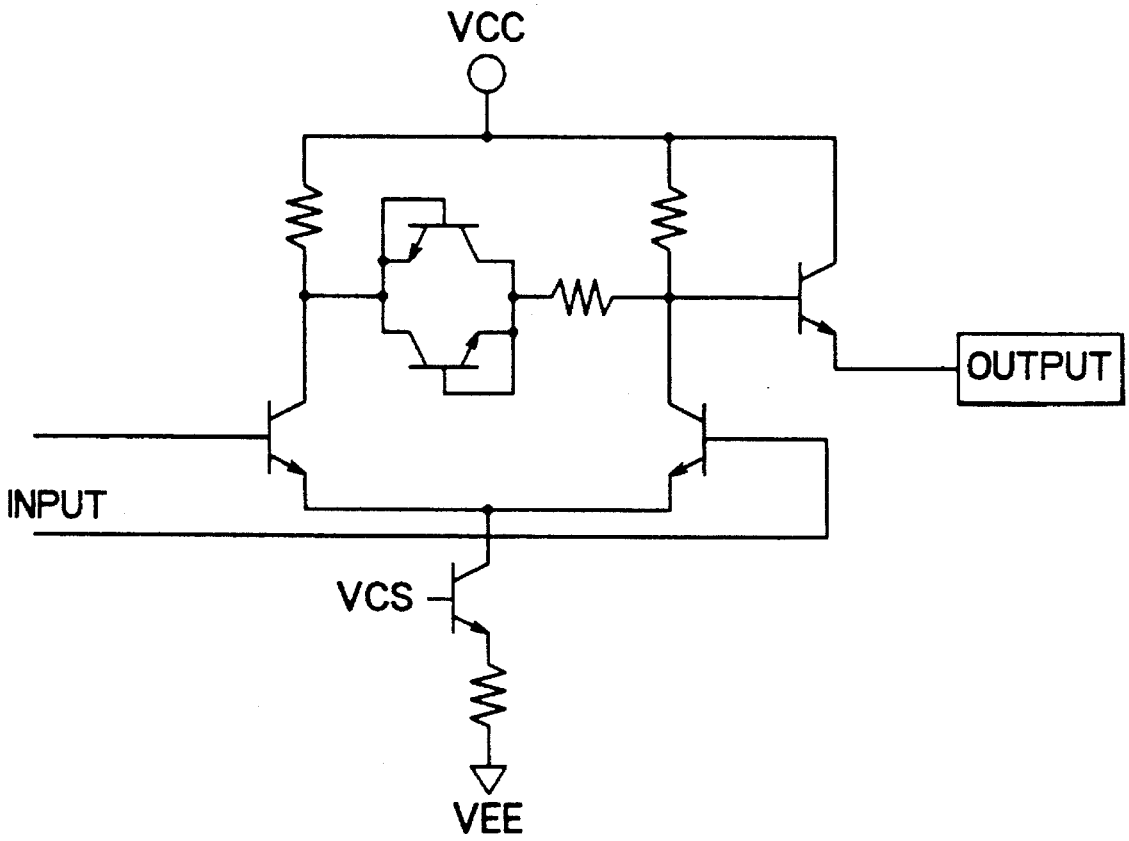
FIG. 17 PRIOR ART
FIG. 17 is a schematic circuit diagram showing a conventional ECL output buffer circuit.

FIG. 17 shows an output buffer circuit according to 100k ECL conventionally employed for compensating for the power supply voltage dependence and the temperature dependence of an output voltage. In relation to the ECL level output, a high level VOH is expressed by:

$$-VOH=2\cdot VCS/3,$$

while a low level VOL is expressed by:

$$-VOL=4\cdot VCS/3$$

It will be understood that for eliminating temperature dependence and power supply voltage dependence from these values, in other words, for deriving an ECL output level free of temperature dependence and power supply voltage dependence at the ECL output terminal of the circuit shown in FIG. 17, a constant voltage VCS free of temperature dependence and power supply voltage dependence may be applied.

However, this circuit implies problems as described below. Since a compensation mechanism for temperature dependence of the output buffer circuit shown in FIG. 17 requires a bipolar transistor and a resistive element in a constant current source section, this output buffer circuit is rendered inoperable with a power supply voltage of about 2.8 volts or less if the circuit is operated without saturating the bipolar transistor. In order to ensure a stable operation with a power supply voltage of 3 volts, it is necessary to ensure that the circuit is operable with a power supply voltage of about 2.4 volts, taking into account a voltage drop of an internal power supply voltage due to the wire resistance and so on in the LSI chip. The following description will prove that an operable minimum power supply voltage of the circuit shown in FIG. 17 is about 2.8 volts.

In the following explanation, VCC is assumed to be a reference voltage at 0 volt. Since an output amplitude of the ECL is about 0.8 volts, when a low level of the ECL is being outputted, the base of the output bipolar transistor is at a voltage of −0.8 volts. For preventing the bipolar transistor of a current switch from being saturated, a high level of a base voltage of a bipolar transistor on the right side of the current switch must also be at −0.8 volts or less. Therefore, a voltage at the common emitters of the current switch is −1.6 volts. When the power supply voltage is −2.5 volts, the constant current source section formed by a bipolar transistor and a resistor is applied only with a voltage of 0.9 volts. However, since the base VCS of the bipolar transistor in the current source section is applied with a voltage of about 1.5·VBE, this bipolar transistor will be saturated. The prior art had a problem as described above.

Figure 4:
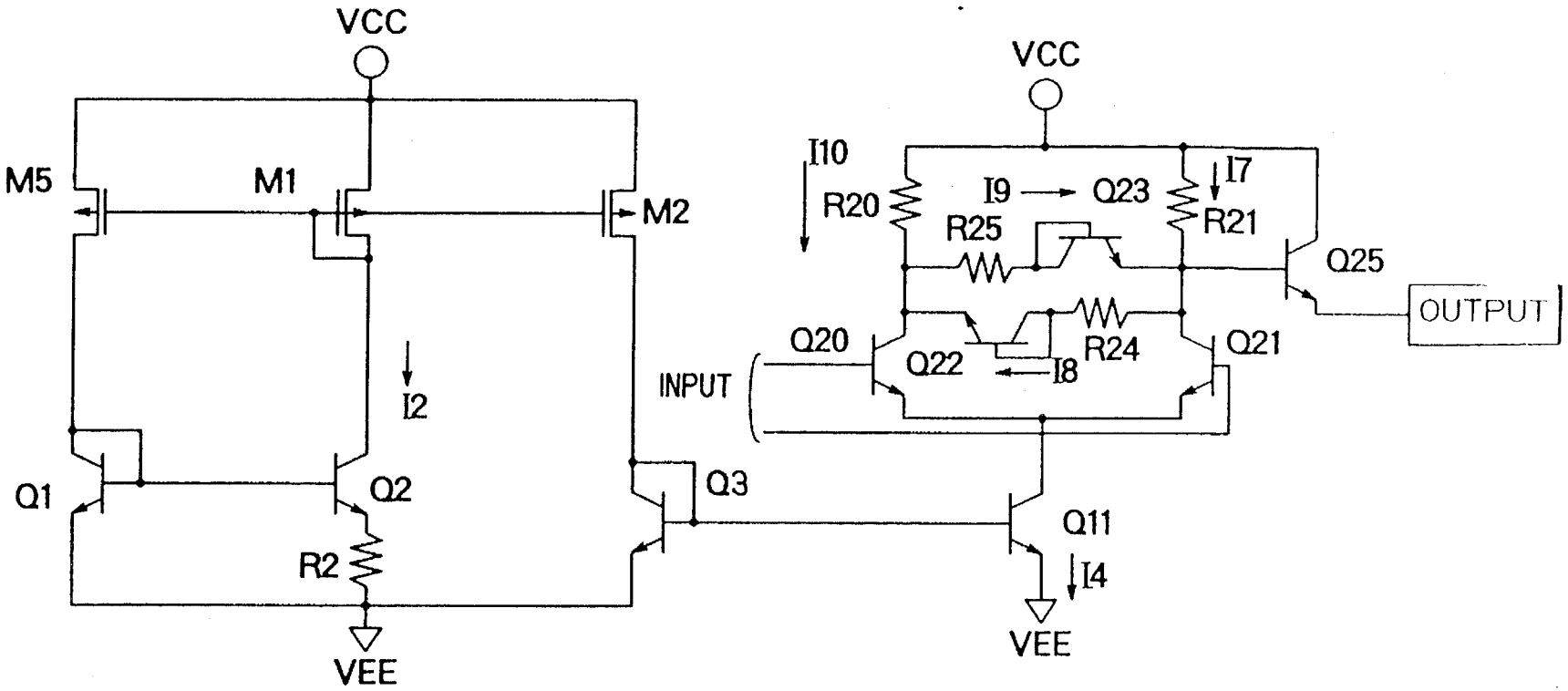
FIG. 4 is a schematic circuit diagram showing an embodiment of an ECL output buffer circuit according to the present invention.

FIG. 4 shows an example of an ECL output buffer according to the present invention.

Bipolar transistors Q20, Q21 and resistive elements R20, R21 form a current switch by connecting the emitters of the bipolar transistors Q20, Q21, connecting this emitter-to-emitter connection to a current source circuit, and connecting the collectors of the bipolar transistors Q20, Q21 to a high voltage side power supply through the resistive elements R20, R21.

The current switch is supplied with complementary signals respectively from the bases of the bipolar transistors Q20, Q21. An output signal of the current switch appears as a collector voltage of the bipolar transistor Q21 and is finally taken from the emitter of an output bipolar transistor Q25 which has the base connected to the collector of the bipolar transistor Q21.

The present embodiment features that a circuit for generating a current having positive dependence on temperature changes connected with a current mirror is employed as a current source circuit for the current switch.

This arrangement will be specifically explained below. In the circuit shown in FIG. 4, a circuit formed by MOS transistors M1, M5, bipolar transistors Q1, Q2 and a resistive element R2 generates a current proportional to absolute temperature, similar to the circuit of FIG. 2. Then, by the intervention of a current mirror formed by the transistors M1, M2 and a current mirror formed by bipolar transistors Q3, Q11, the bipolar transistor Q11 is also applied with the current proportional to absolute temperature. Thus, a voltage proportional to a thermal voltage is generated across R21. This voltage is added to a base-to-emitter voltage VBE of the bipolar transistor Q25 to derive an output voltage. By appropriately selecting circuit parameters such as a resistance value of the resistive element, emitter sizes of the bipolar transistors and so on, the temperature dependence can be eliminated from the output voltage.

Specifically, absolute values of the temperature dependence of the voltage K·VT (k is a proportional constant determined by the circuit parameters) generated across the resistive element R21 and VBE of the bipolar transistor Q25 may be set to the same value.

Also, by providing a resistive element R25, a bipolar transistor Q23 used as a diode, a resistive element R24 and a bipolar transistor Q22 used as a diode, the temperature dependence can be more effectively eliminated from the output signal voltage of the output buffer.

The temperature dependence of the output voltage will hereinafter be calculated, assuming that the temperature dependence of the resistive elements is negligible.

The emitter area of the bipolar transistor Q1 is designated A1; the emitter area of the bipolar transistor Q2, A2; an emitter current I1 of Q1, and an emitter current I2 of Q2, I4, I7, I8, I9 and I10 represent currents respectively flowing through parts indicated by arrows in the drawing. Since I4 is rendered proportional to I2 by the current mirror circuit formed by the MOS transistors M1, M2 and the bipolar transistors Q3, Q11, I4 may be expressed by the following equation using I2:

$$I4=A\cdot I2 \tag{1}$$

where A is a proportional constant determined by the parameters of the current mirror circuit.

When the output voltage is at low level, the following equations are satisfied:

$$I4=I7+I10 \tag{2}$$

$$I10=I9 \tag{3}$$

$$I7\cdot R21=I10\cdot R20+VBE23+I9\cdot R25 \tag{4}$$

where VBE23 is the base-to-emitter voltage of the bipolar transistor Q23. The base current of the bipolar transistor Q25 is assumed to be negligible. Solving the equations (2), (3) and (4) about I7:

$$I7\cdot R21=R21/Ra\cdot I4\cdot(R20+R25)+R21/Ra\cdot VBE23 \tag{5}$$

where Ra represents the sum of R21, R20 and R25.

When the output voltage is at high level, the following equations are satisfied:

$$I4=I10+I8 \tag{6}$$

$$I8=I7 \tag{7}$$

On the assumption that the base current of the bipolar transistor Q25 is sufficiently small, the following equation (8) is satisfied:

$$I10\cdot R20=I8\cdot(R21+R24)+VBE22 \tag{8}$$

Therefore, from the equations (6) and (8), when the output voltage is at high level, the equation (9) is derived:

$$I7\cdot R21=(I4\cdot R20-VBE24)\cdot R21/Rb \tag{9}$$

where Rb represents the sum of R21, R24 and R20.

Assuming that VBE1 is the base-to-emitter voltage of the bipolar transistor Q1, and VBE2 is the base-to-emitter voltage of the bipolar transistor Q2, VBE1 and VBE2 are expressed by the following equations using I1 and I2:

$$VBE1=kT/q\cdot \ln(I1/A1Is) \tag{10}$$

$$VBE2=kT/q\cdot \ln(I2/A2Is) \tag{11}$$

where k is the Boltzmann's constant, T is absolute temperature, q is is the prime charge, and Is a saturation current of the bipolar transistor. Here, since the voltage across R2 is given by VBE1−VBE2, I2 is expressed using I1, I2, R2, A1 and A2:

$$I2=kT/q\cdot \ln(I1A2/I2A1)/R2 \tag{12}$$

The temperature dependence of I2, i.e., dI2/dT is expressed by differentiating the equation (12) by temperature T:

$$dI2/dT=(k/q\cdot \ln r+kT/q\cdot dr/dT/r)/R2 \tag{13}$$

where $r=I1A2/I2A1$. In the equation (13), assuming that the temperature dependence of r is suppressed to be sufficiently small by the current mirror circuit formed by MOS transistors as compared with r itself, i.e., that dr/dT/r=0, the equation (13) is transformed to:

$$dI2/dT=k/q\cdot \ln r/R2=I2/T \tag{14}$$

In regard to the output voltage of the ECL output buffer, the low level is derived from the equation (5) as:

$$\begin{aligned} -VOL &= I7\cdot R21+VBE25 \\ &= R21\cdot(R20+R25)/Ra\cdot I4+ \\ &\quad R21/Ra\cdot VBE23+VBE25 \end{aligned} \tag{15}$$

and the high level is derived from the equation (9) as:

$$\begin{aligned} -VOH &= I7\cdot R21+VBE25 \\ &= (I4\cdot R20-VBE22)\cdot R21/Rb+VBE25 \end{aligned} \tag{16}$$

Differentiating the equations (15) and (16) by temperature T, the following equations (16), (17) are derived:

$$-dVOL/dT=dI4/dT\cdot R21\cdot(R20+R25)/Ra+R21/Ra\cdot dVBE23/dT+dVBE25/dT \tag{17}$$

$$-dVOH/dT=(dI4/dT\cdot R25-dVBE22/dT)\cdot R21/Rb+dVBE22/dT \tag{18}$$

From conditions under which −dVOL/dT and −dVOH/dT in the equations (17) and (18) are zero and from the equations (1) and (14), the following equations (19) and (20) are derived:

$$-dVOL/dT = A \cdot I2/T \cdot R21 \cdot (R20 + R25)/Ra + (R21 + Ra)/Ra \cdot dVBE/dT = 0\ \text{V} \quad (19)$$

$$-dVOH/dT = A \cdot I2/T \cdot (R21 \cdot R20/Rb) + (R24 + R20)/Rb \cdot dVBE/dT = 0\ \text{V} \quad (20)$$

It should be noted that in the above equations VBE25, VBE22 and VBE 23 are assumed to be equal and these are represented by VBE. The temperature dependence (dVBE/dT) of VBE is assumed to be equal among the bipolar transistors Q25, Q22 and Q23. If the circuit constants are determined so as to satisfy the equations (19) and (20), an ECL output buffer free of temperature dependence is provided in the vicinity of the temperature conditions supposed under the foregoing assumptions.

The embodiment shown in FIG. 4 produces an effect that the current source section of the output buffer is arranged to operate at a lower power supply voltage in comparison with a current source of a conventional output buffer formed by bipolar transistors and resistors.

Specifically, a minimum operable power supply voltage of the power supply circuit section is about 1.8 volts, similarly to the circuit shown in FIG. 3. Also, a minimum operable power supply voltage of the output buffer circuit is about 2.4 volts as described below. From the standard of the ECL output amplitude, a necessary voltage across the resistive element R21 is determined to be about 0.8 volts. Another voltage of about 0.8 volts is required to prevent the saturation of the bipolar transistors Q20, Q21. A further voltage of about 0.8 volts is required to prevent the saturation of the bipolar transistor Q11 of the current source. Therefore, the output buffer section is operable with a total of about 2.4 volts of the power supply voltage. If these bipolar transistors are permitted to be slightly saturated, the buffer section is operable with a lower power supply voltage.

The present embodiment produces an effect that an output buffer operable with a low power supply voltage of about 2.4 volts is provided, which ensures the ECL output levels independent of power supply voltage and temperature. For example, the input/output standard of 100k ECL can be satisfied with an integrated circuit which may operate with an externally supplied power supply voltage of 2.4 volts.

Figure 5:
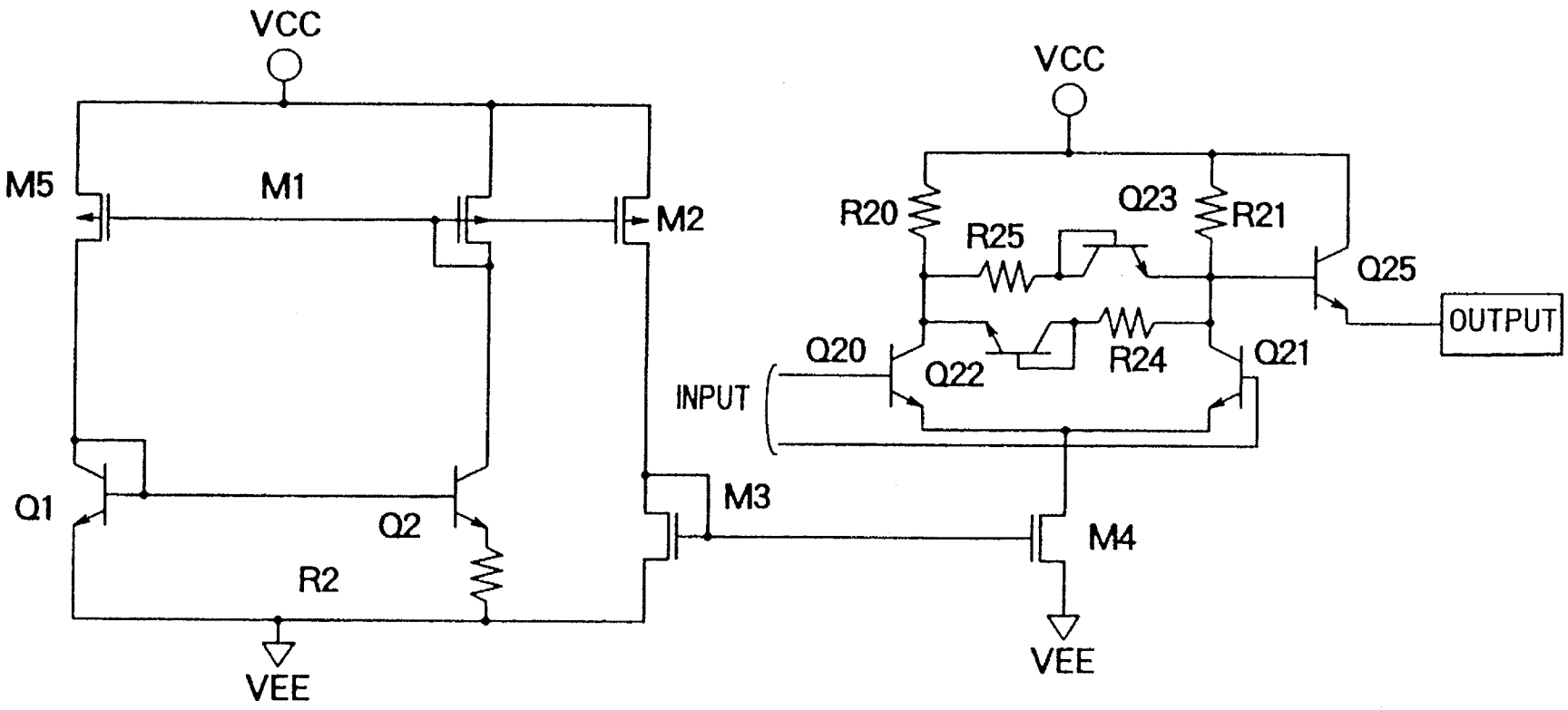
FIG. 5 is a schematic circuit diagram showing another embodiment of the ECL output buffer circuit according to the present invention.

Another embodiment will next be explained with reference to FIG. 5. FIG. 5 differs from FIG. 4 in that for transmitting a signal from a constant current source, the circuit of FIG. 4 employs a current mirror circuit formed by bipolar transistors, while the circuit of FIG. 5 employs a current mirror circuit formed by MOS transistors (M3, M4).

A current mirror circuit formed by bipolar transistors has characteristics less susceptible to the influence of power supply noise than a current mirror circuit formed by MOS transistors. The power supply noise in this case refers to fluctuations in gate voltages of the MOS transistors by certain reasons, which affects the output of the circuit.

However, a minimum operable power supply voltage of a MOS transistor is not determined by the saturation, as is the case of a bipolar transistor. The effect produced by the circuit of FIG. 5 is that if a MOS transistor presenting a sufficiently low on-resistance between the source and the drain is employed in the current source section, the circuit can be operated at a lower power supply voltage than a circuit employing bipolar transistors. Also, in the circuit arrangement of the present embodiment, the minimum necessary voltage across the power supply terminals is the sum of the base-to-emitter voltage of the bipolar transistor and the drain voltage for using the MOS transistor in the saturation region, with the result that the power supply section is operable even with a power supply voltage of about 1.8 volts, thereby making it possible to reduce the power supply voltage.

Figure 6:
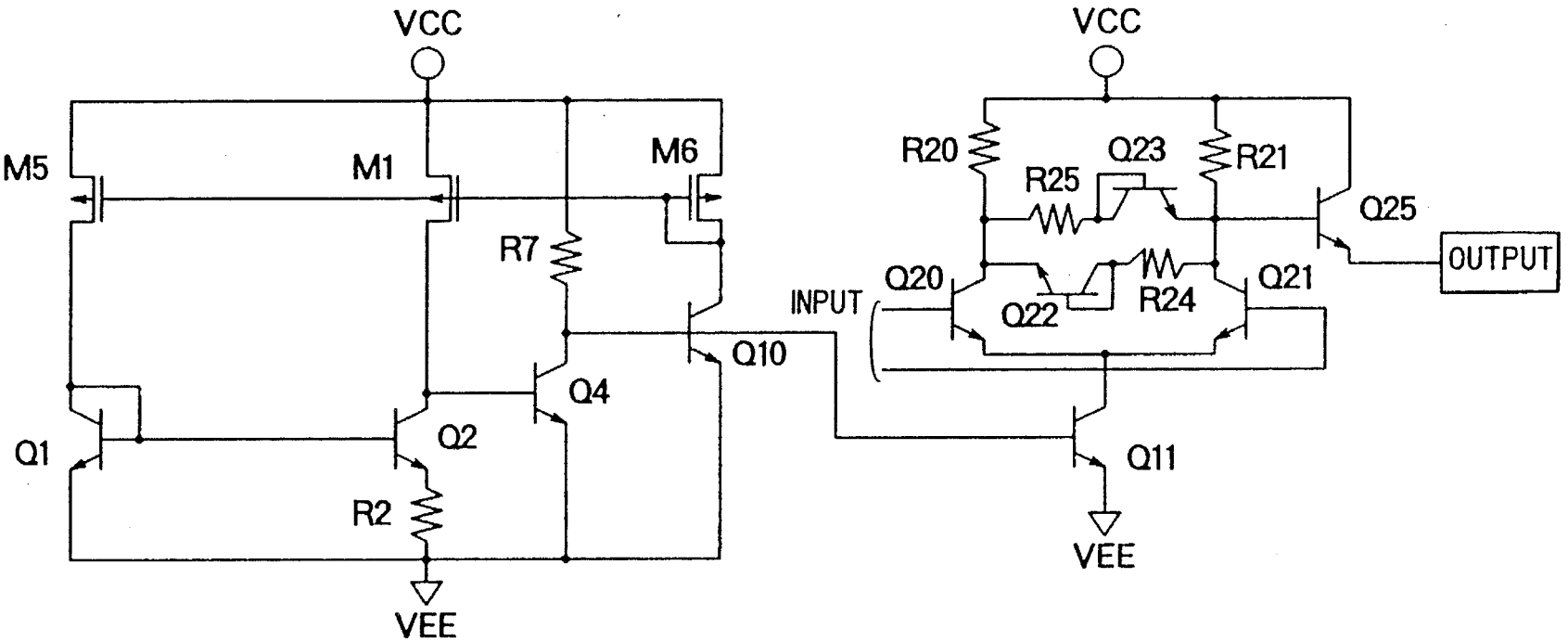
FIG. 6 is a schematic circuit diagram showing a further embodiment of the ECL output buffer circuit according to the present invention.

A further embodiment will be explained with reference to FIG. 6. The left side of the circuit shown in FIG. 6 is a reference current generation circuit for canceling fluctuations in power supply, described in connection with FIG. 3, which would otherwise appear in the output thereof, while the circuit on the right side of the drawing is an ECL output buffer circuit explained in connection with FIG. 4.

Similarly to FIG. 4, a current proportional to that flowing through the bipolar transistor Q10 flows through the bipolar transistor Q11. Since the current flowing through the bipolar transistor Q10 does not depend on the power supply voltage, but is proportional to absolute temperature, similarly to the circuit of FIG. 3, a like current flows through the bipolar transistor Q11. By virtue of this current, the high level and the low level of the output voltage are made free of the temperature dependence and the power supply voltage dependence, as described above.

Figure 7:
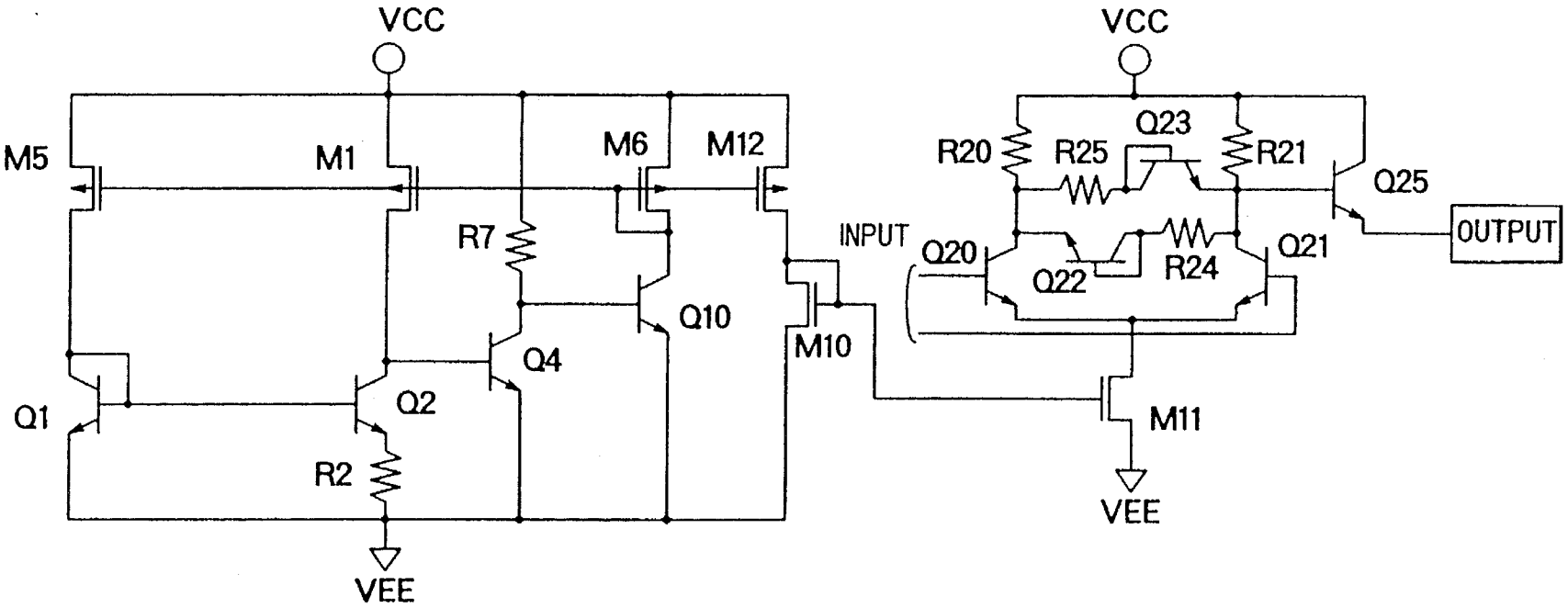
FIG. 7 is a schematic circuit diagram showing a yet further embodiment of the ECL output buffer circuit according to the present invention.

A yet further embodiment will be explained with reference to FIG. 7. FIG. 7 differs from FIG. 6 in that for transmitting a signal from a constant current source, the circuit of FIG. 6 employs a current mirror circuit formed by bipolar transistors, while the circuit of FIG. 7 employs a current mirror circuit formed by MOS transistors M6, M12 and another current mirror circuit formed by MOS transistors M10, M11.

The effect produced by the circuit arrangement of the present embodiment is to provide an ECL output buffer circuit which derives a constant output irrespective of fluctuations in power supply voltage and independent of temperature.

Figure 8:
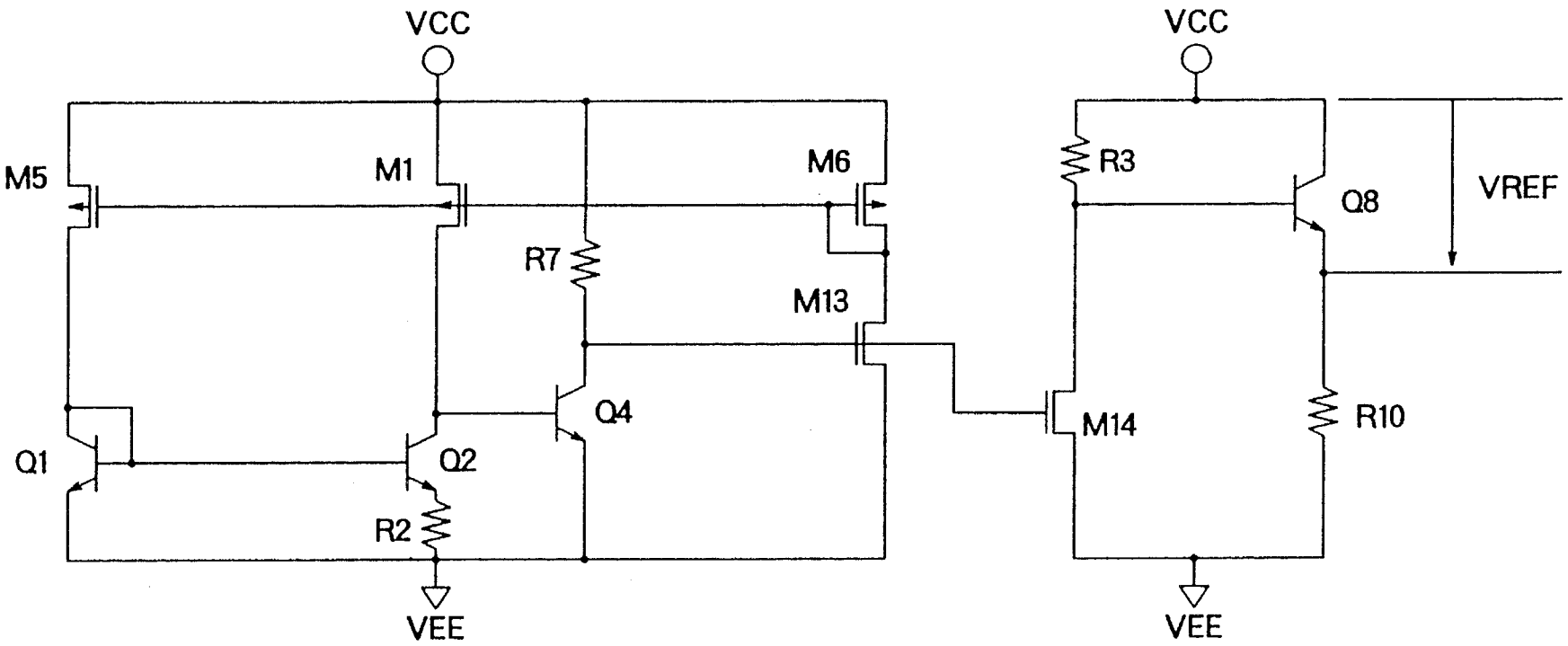
FIG. 8 is a schematic circuit diagram showing an embodiment of a constant voltage generation circuit according to the present invention.

FIG. 8 shows another example of the constant voltage generation circuit according to the present invention. In the circuit shown in FIG. 8, the bipolar transistors Q10, Q5 in FIG. 3 for generating currents in proportional relationship are replaced by MOS transistors M13, M14. Similarly to FIG. 3, such currents in proportional relationship also flow through M13, M14 in FIG. 8.

A minimum power supply voltage necessary to operate the circuit of FIG. 8 is determined in the following manner. Since the MOS transistor M5 needs to be used in the saturation region of the MOS transistor, a voltage of about 1.0 volt is required between the source and the drain of the MOS transistor M5. This value varies depending on the setting of the gate voltage of the MOS transistor. Also, a voltage of about 0.8 volts is necessary for the base-to-emitter voltage of the bipolar transistor Q1. This value also varies depending on the characteristics of the transistor and the current value. Therefore, the circuit of the present embodiment is operable with a total of about 1.8 volts of the power supply voltage.

The effect of the present embodiment is to provide a power supply circuit suitable to generate an input threshold value for an ECL input buffer which does not present the power supply voltage dependence or the temperature dependence even with a low power supply voltage of about 1.8 volts.

The operation of this circuit arrangement will next be explained. The MOS transistors M1, M5, M6 constitute a current mirror circuit, and a current proportional to that flowing through the MOS transistors M1, M5 flows through a transistor M13. As described above, since a current proportional to absolute temperature flows through the MOS transistor M1, a current proportional to absolute temperature also flows through the MOS transistor M13. As the power supply voltage rises, source-to-drain voltages of the MOS transistors M1, M5 increase, resulting in increasing currents flowing through these MOS transistors. By thus increasing currents, the base voltage of a bipolar transistor Q4 becomes higher, the gate voltage of the MOS transistor M13 is lowered, and the current flowing through the MOS transistor M6 is reduced, thereby canceling the effect of an increase in the power supply current.

Since the MOS transistor M14 has the source, gate and substrate connected with the correspondents of the MOS transistor M13, a current proportional to absolute temperature but independent of power supply voltage flows therethrough. This current causes the current proportional to absolute temperature to flow through R3, thereby generating a voltage proportional thereto across R3. This voltage is added to VBE of the bipolar transistor Q8 to derive an output voltage VREF. The output voltage VREF is therefore free of the temperature dependence and the power supply voltage dependence.

Figure 9:
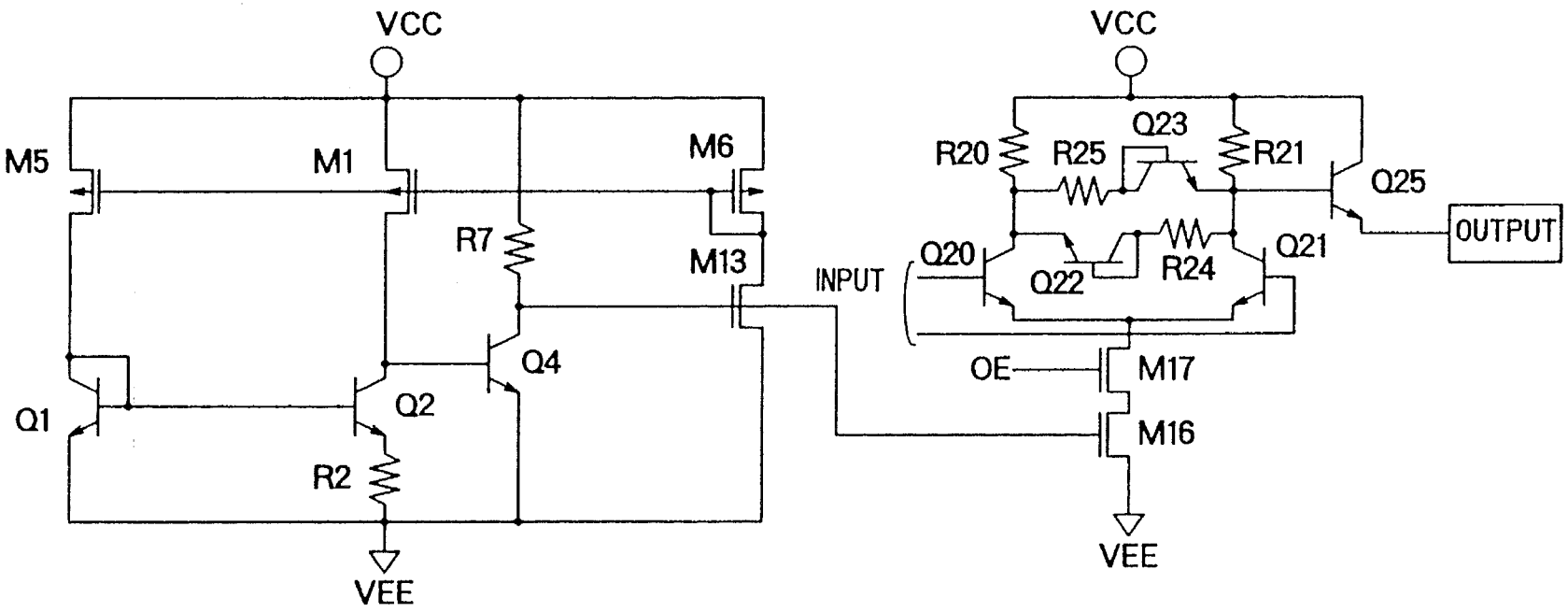
FIG. 9 is a schematic circuit diagram showing another embodiment of the ECL output buffer circuit according to the present invention.

FIG. 9 shows another example of the ECL output buffer circuit according to the present invention. The circuit on the left side of FIG. 9 is a reference current generation circuit for canceling fluctuations in power supply, described in connection with FIG. 8, which would otherwise appear in the output thereof, while the circuit on the right side of the drawing is an ECL output buffer circuit, explained in connection with FIG. 5, which is additionally provided with a MOS transistor M17 for switching off an output current during stand-by.

A MOS transistor M16 has its gate and source common to a MOS transistor M13, and a drain voltage thereof follows fluctuations in power supply voltage, so that a current proportional to that flowing through the MOS transistor M13 flows through the MOS transistor M16. Since the current flowing through the MOS transistor M13 does not depend on power supply voltage and is proportional to absolute temperature, similarly to the circuit of FIG. 8, a like current flows through the MOS transistor M16. Thus, the high level and the low level of the output voltage are free of temperature dependence and power supply voltage dependence, as described above.

During the operation of the output buffer, a MOS transistor 17 is applied with a high level signal at the gate thereof, and the output buffer is supplied with a current. During stand-by, the gate is applied with a low level signal to save consumed current, and the base current of an output transistor Q25 is shut off. The MOS transistor M17 may be made sufficiently large for supplying an output current.

A minimum power supply voltage with which the power supply section is operable is about 1.8 volts. on the other hand, a minimum operable power supply voltage of the output buffer circuit is determined to be about 1.8 volts as follows.

From the standard of the ECL output amplitude, a necessary voltage across the resistive element R21 is about 0.8 volts. Another about 0.8 volts is required to prevent the bipolar transistors Q20, Q21 from being saturated. Further, about 0.2 volts are required for the MOS transistor M16 in the current source to operate in a saturation region. Thus, the output buffer circuit is operable with the total of about 1.8 volts. By setting a gate voltage of M13, M16 can be operated in the saturation region even with a source-to-drain voltage being at about 0.2 volts. If the saturation prevented bipolar transistors are permitted to be slightly saturated, the Buffer circuit is operable with the lower power supply voltage. Also, the operation of these bipolar transistors is possible by setting the gate voltage of the MOS transistor M13 at a lower value.

An effect of the present embodiment is to provide an output buffer which ensures the ECL output levels independent of power supply voltage or temperature with a lower power supply voltage of about 1.8 volts. For example, the input/output standard of 100k ECL can be satisfied with an integrated circuit which is supplied with an external power supply voltage of 1.8 volts, thereby making it possible to reduce the power consumption of the integrated circuit.

Another effect of the present embodiment is to provide an ECL output buffer which can save consumed current during stand-by.

Figure 10:
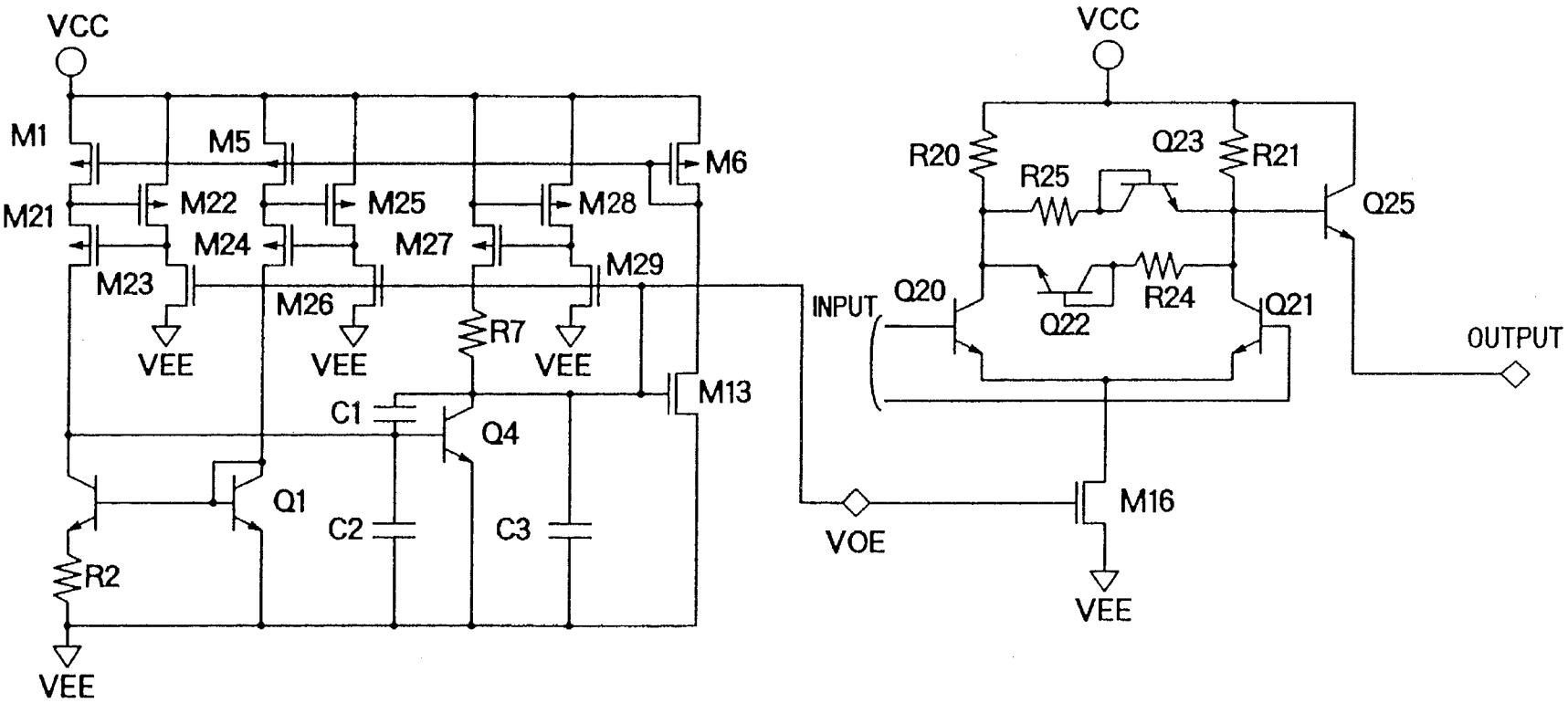
FIG. 10 is a schematic circuit diagram showing an ECL buffer which is an embodiment of the present invention.

FIG. 10 shows another example of the ECL output buffer circuit according to the present invention.

The circuit on the left side of FIG. 10 is a reference voltage generation circuit for canceling variations in power supply voltage and variations in temperature which would otherwise appear in the output of the ECL output buffer. The circuit on the right side of FIG. 10 is similar to the ECL output buffer circuit which has been explained in connection with FIG. 9.

The circuit of FIG. 10 differs from that of FIG. 9 in that MOS transistors M5, M1, M6 of FIG. 10 are connected with a regulated cascade current mirror circuit additionally comprising MOS transistors M21–M29 and M13. The regulated cascade current mirror circuit is described, for example, in "VLSI DESIGN TECHNIQUES FOR ANALOG AND DIGITAL CIRCUITS" (Randall L. Geiger, Phillip E. Allen and Noel R. Strader, McGRAW-HILL, 1990).

The circuit of FIG. 10 is provided to reduce the power supply voltage dependence of the circuit characteristics of FIG. 9. The circuit of FIG. 10 is additionally provided with MOS transistors M21, M22, M23, M24, M25, M26, M27, M28 and M29 in order to reduce dependence on power supply voltage of the characteristics. These MOS transistors operate in the following manner to enable the circuit to more correctly operate.

Although the power supply voltage dependence of the circuit in FIG. 9 is made small, it is still large for specific applications because of currents flowing through the MOS transistors M5, M6, M1 connected with the current mirror which each present large power supply voltage dependence. These MOS transistors differ from each other in the power supply voltage dependence of the current because the power supply voltage dependence of their drain voltages are different from each other. For example, a drain voltage of the MOS transistor M5 is determined on the basis of a low voltage side power supply because of the existence of a bipolar transistor Q1. On the other hand, since the drain of the MOS transistor M6 is connected with the gate of the same, the drain voltage thereof is determined by the high voltage side power supply. For this reason, if the power supply voltage which is the difference in the power supply voltage between the lower voltage-side and the high voltage side varies, the drain voltages of the MOS transistor M5 and the MOS transistor M6 respectively vary without correlation, whereby different magnitudes of currents flow through the respective MOS transistors.

The circuit of FIG. 10, to cope with this problem, matches the power supply voltage dependence of the two MOS transistors in the following manner. Since M23 and M13 are connected by way of the current mirror, currents in proportional relationship flow therethrough. M21 is a transistor for determining the drain voltage of M23 on the basis of the voltage on the high voltage side. This configuration allows the currents in proportional relationship to flow through the MOS transistors M22 and M6, respectively. For this reason, drain voltages of the transistors M1 and M6 are both determined on the basis of the high voltage side power supply. It is therefore possible to reduce the power supply voltage dependence of the ratio of the current flowing through the MOS transistor M1 to a current flowing through the MOS transistor M6 as compared with the case of FIG. 9.

The MOS transistors M24, M25 and M26 act similarly to the MOS transistors M21, M22 and M23. A circuit formed by the MOS transistors M27, M28 and M29 eliminates the power supply voltage dependence of a current flowing through a resistive element R7 and reduces power consumption.

Capacitors C1, C2, C3 in the circuit of FIG. 10 are provided for preventing oscillations caused by a feedback amplifier formed by Q4 and R7.

VOE in FIG. 10 designates a terminal used when a power supply circuit is used commonly with another circuit other than the output buffer circuit of the present embodiment (for example, an input buffer circuit).

Figure 11:
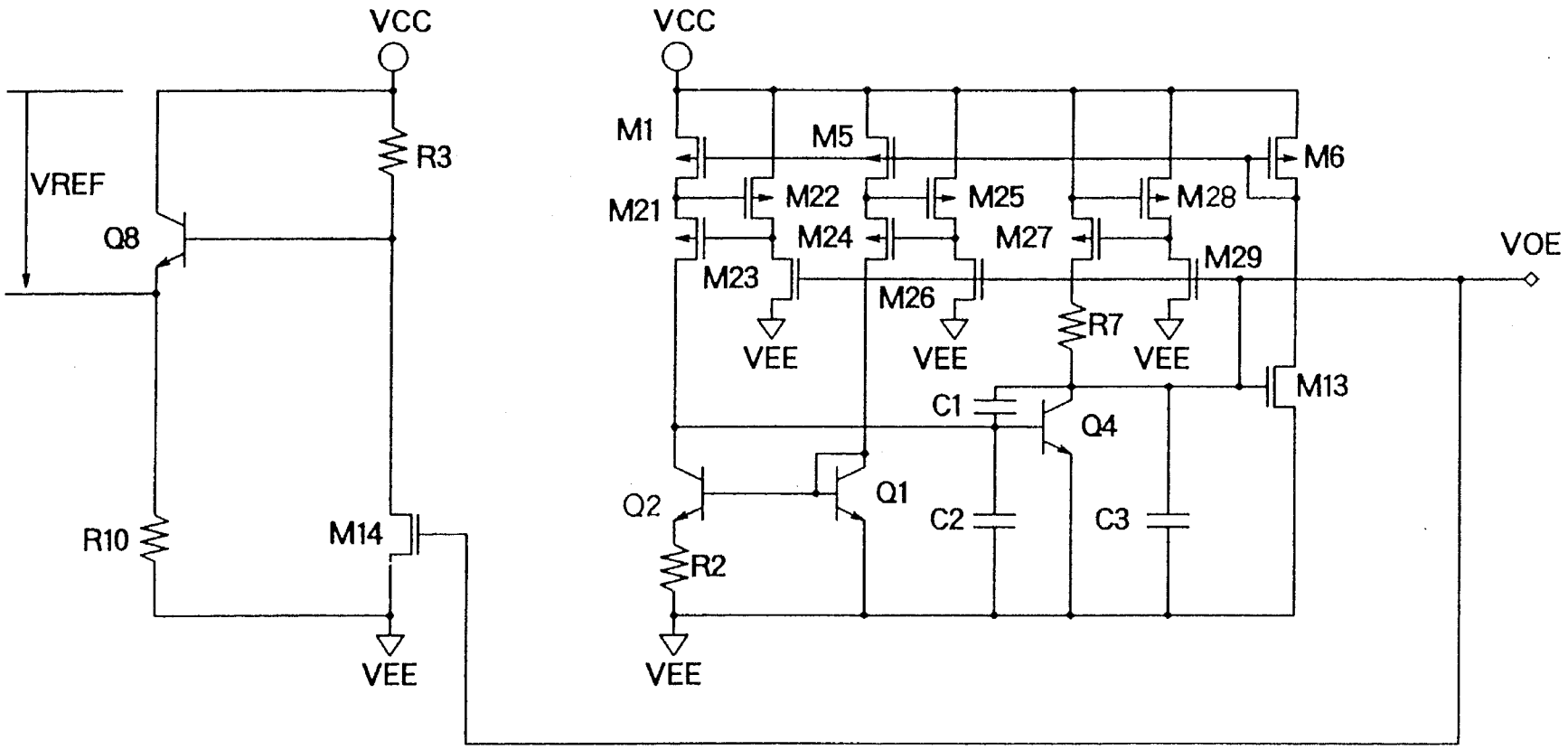
FIG. 11 is a schematic circuit diagram showing an embodiment of a constant voltage generation circuit according to the present invention.

FIG. 11 shows an improved reference voltage generation circuit which further reduces the power supply voltage dependence of the characteristics of the circuit shown in FIG. 8. While the basic configuration of this circuit is substantially equal to that of FIG. 8, it features that a regulated cascade current mirror circuit is employed, similarly to the circuit of FIG. 10. Elements in FIG. 11 designated the same references have functions similar to the elements in FIG. 10. VOE in FIG. 11 also designates a terminal for commonly using a power supply circuit. A voltage VREF generated by the circuit of FIG. 11 is supplied to an ECL input buffer of, for example, a semiconductor memory device. As is apparent from a comparison with the circuit of FIG. 10, it is understood that a power supply circuit can be commonly used for an input buffer circuit and an output buffer circuit by way of the terminal VOE.

From the foregoing, it will be clearly appreciated that all the circuits hereinbefore explained contribute to the common use of a power supply circuit.

Next, explanation will be given of a semiconductor memory device to which the circuit of the present invention is applied.

It is apparent that if the foregoing output buffer circuit and regulated voltage circuit are applied to a semiconductor memory device, a highly reliable semiconductor memory device can be realized which is resistant to variations in temperature and power supply voltage. In the following, common use of a power supply circuit is taken as an example and particularly explained.

Figure 12:
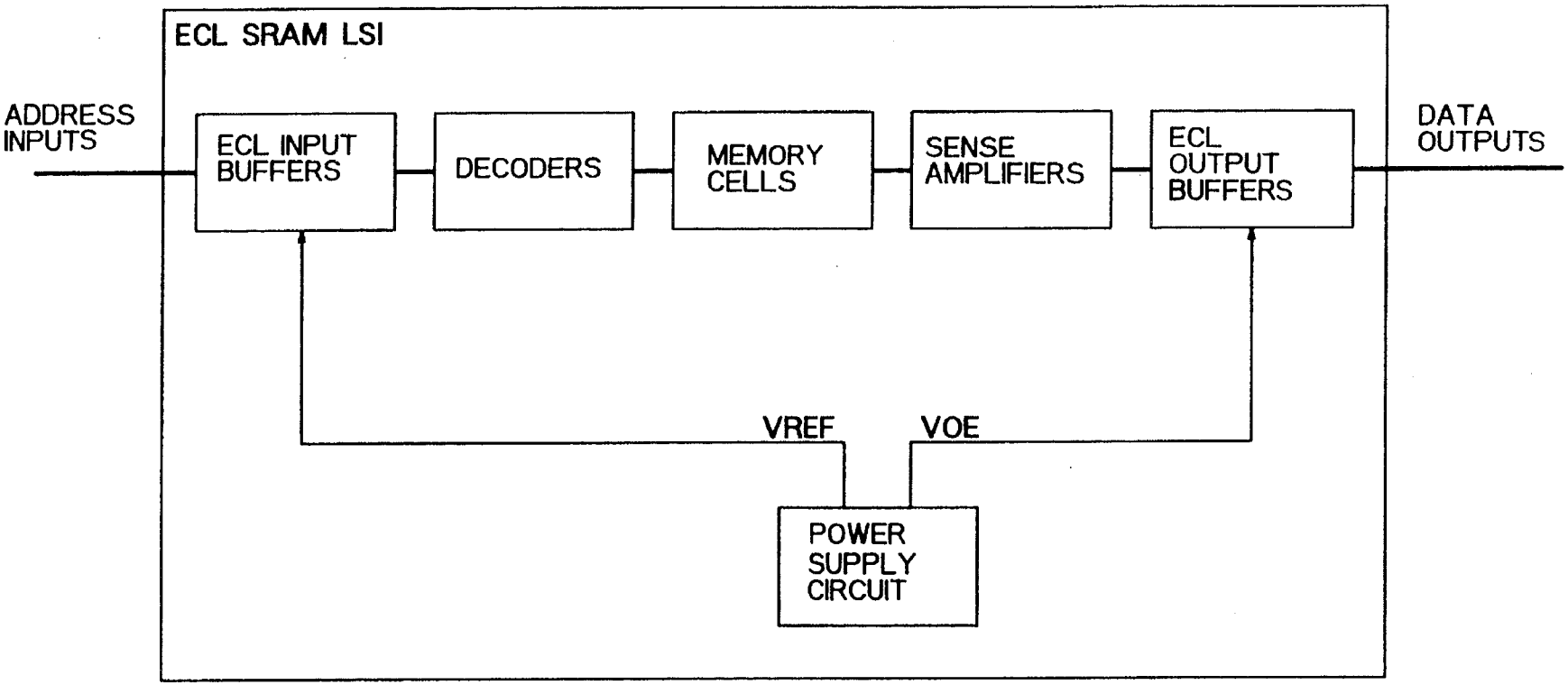
FIG. 12 is a block diagram showing an embodiment of a semiconductor memory device according to the present invention.

FIG. 12 shows an exemplary block diagram of a SRAM LSI having the ECL input/output which employs the power supply circuit of the present invention. The basic configuration of a SRAM is well-known and may be divided into an input buffer, an address decoder, memory cells, sense amplifiers, and an output buffer as shown in the drawing. These components correspond to minimally required functions, and an LSI generally includes therein other circuits which perform a variety of functions.

In FIG. 12, the input buffer and the output buffer commonly uses a power supply circuit. VREF and VOE in the drawing designate those generated, for example, by the circuits of FIG. 11 and FIG. 10.

FIG. 12 shows an example of an LSI having the ECL input/output so that the DC characteristics of the input/output buffers must match the ECL standard. By employing the present invention, an SRAM LSI can be provided which complies with the ECL standard.

Specifically, the effects described above are produced by reducing the temperature dependence and the power supply dependence of three values, i.e., a logical threshold value of an input signal to the ECL input buffer; and a logical high level and a logical low level of the ECL output buffer.

Figure 13:
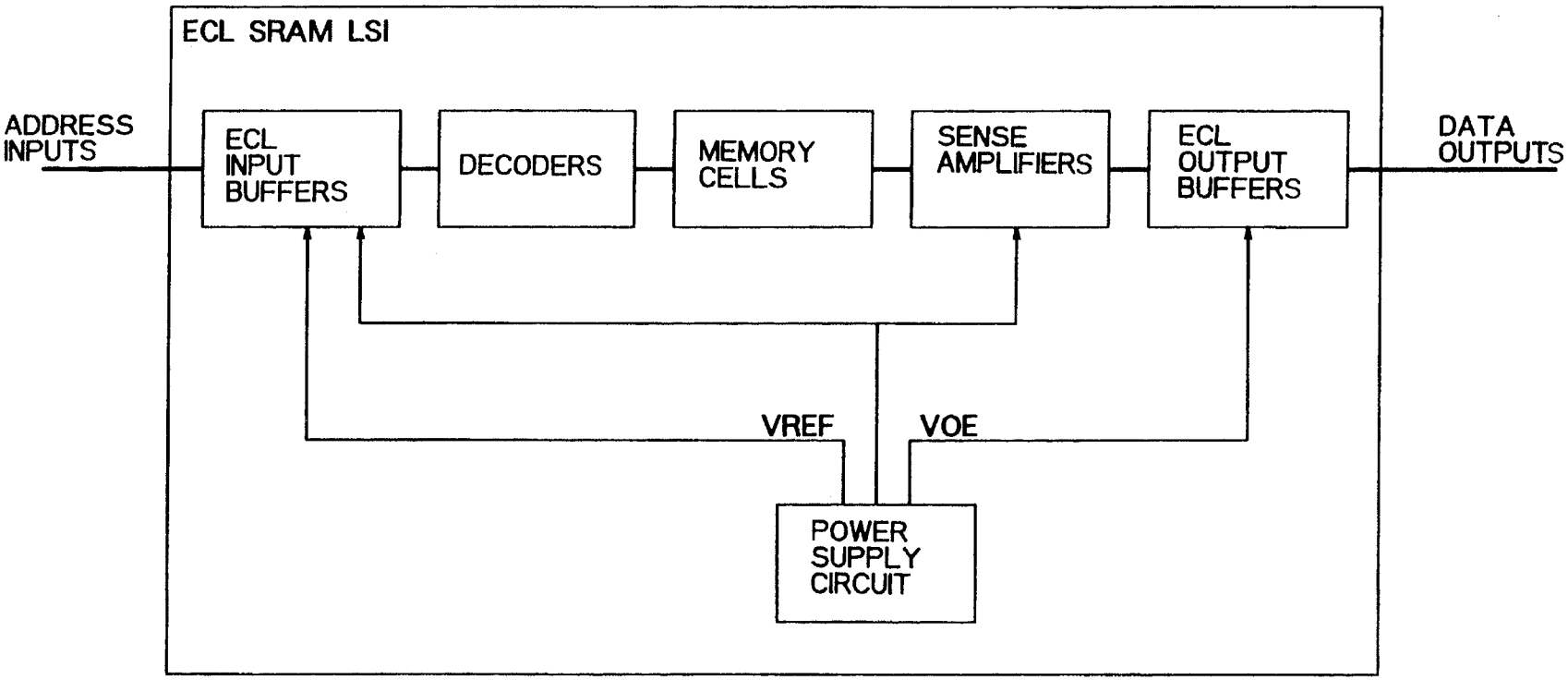
FIG. 13 is a block diagram showing another embodiment of the semiconductor memory device according to the present invention.

FIG. 13 shows an example in which a power supply circuit is commonly used also by sense amplifiers as well as by input and output buffer circuits.

Generally, in an ECL SRAM, a current switch circuit formed by bipolar transistors is employed in an input buffer and a sense amplifier. While the current switch circuit has a current source section, its performance largely varies depending upon the magnitude of a current supplied by the current source section. However, the magnitude of a current supplied by a current source section generally varies due to temperature and a power supply voltage, so that the performances of these circuit portions also vary depending on external parameters such as the temperature and the power supply voltage. The present invention, if applied, can supply these circuits with a current from a novel power supply circuit which does not depend on temperature or power supply voltage, thereby making it possible to reduce the dependence of the characteristics of these circuits on external parameters and provide a stable performance.

Figure 14:
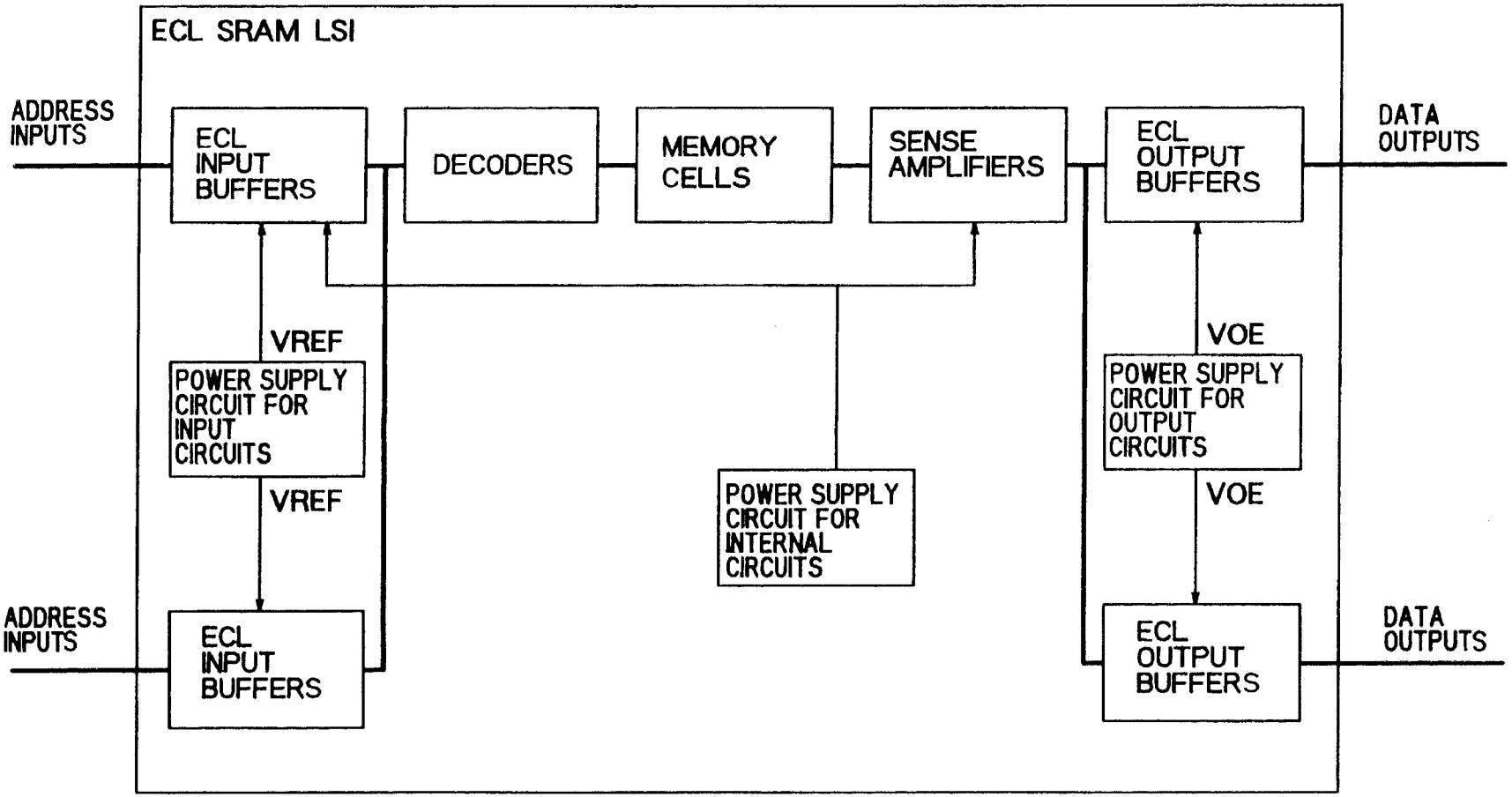
FIG. 14 is a block diagram showing a further embodiment of the semiconductor memory device according to the present invention.
Figure 15:
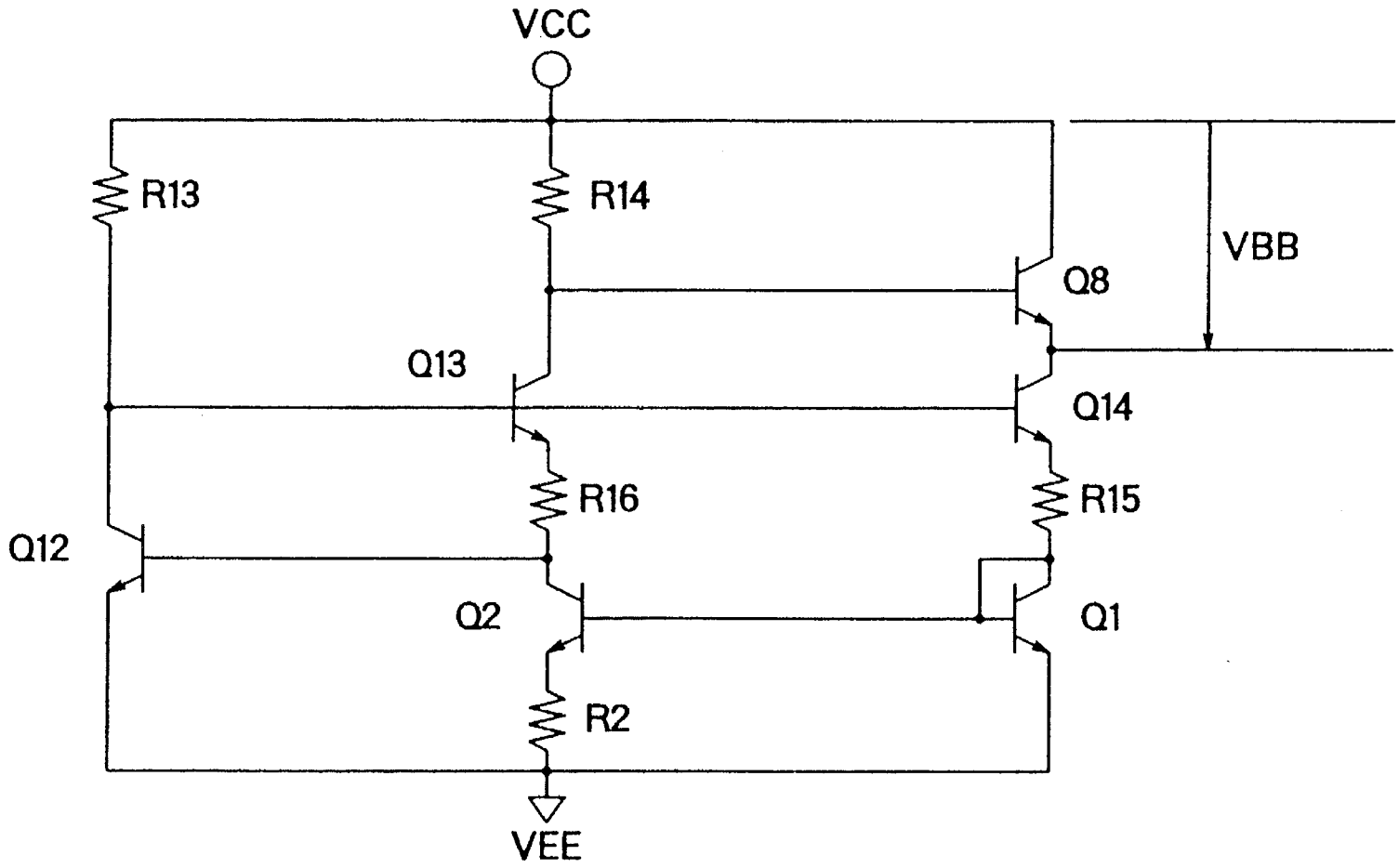
FIG. 15 PRIOR ART
FIG. 15 is a schematic circuit diagram showing a conventional bandgap reference circuit.

FIG. 14 shows another example of an ECL SAM LSI.

Generally, a plurality of sense amplifiers and input/output buffers exist in an LSI chip, and they are not always laid out in a physically near area. In other words, their locations may be often determined by requirements from other factors associated with the layout of the chip. If the power supply circuit is located far from circuits which receive power supply signals (VREF, VOE and so on in the drawing) such as sense Amplifiers in the LSI chip, noise occurring in the chip easily enters into the power supply signals, thereby causing fluctuations in the circuit performance. Also, a voltage drop on power supply lines due to a current consumption in the LSI chip causes voltages on the power supply lines to be different at different locations in the chip, which also results in fluctuations in the circuit performance.

Shown in FIG. 14 is a block diagram of an SRAM LSI which is provided with separate power supply circuits for an input circuit, an internal circuit and an output circuit, respectively, and to which the circuit of the present invention is applied. This configuration allows the respective power supply circuits to be located near the respective circuits receiving power supply signals (the input circuit, the internal circuit, the output circuit), thereby eliminating the problems described above.

What is claimed is:

1. A constant voltage generation circuit for generating a constant voltage free of the influence of temperature changes, comprising:

a first circuit for generating a first current having a positive dependence on temperature changes;

a second circuit for converting the first current to a voltage; and a proportional current supply circuit connecting said first circuit with said second circuit so that current flowing through said second circuit is proportional to the first current and is converted to an output voltage free of the influence of temperature changes.

2. A constant voltage generation circuit according to claim 1, wherein said proportional current supply circuit comprises a current mirror circuit formed by bipolar transistors.

3. A constant voltage generation circuit according to claim 1, wherein said proportional current supply circuit comprises a current mirror circuit formed by MOS transistors.

4. A constant voltage generation circuit according to claim 1, wherein said first circuit comprises:

a first bipolar transistor having a collector and a base connected to each other and an emitter adapted to be connected to a low voltage side power supply;

a second bipolar transistor having a base connected to the base of said first bipolar transistor;

a resistive element adapted to be connected between an emitter of said second bipolar transistor and the low voltage side power supply;

a first MOS transistor having a drain connected to the collector of said first bipolar transistor and a source adapted to be connected to a high voltage side power supply; and a second MOS transistor having a gate connected to a gate of said first MOS transistor, a drain connected to a collector of said second bipolar transistor, and a source adapted to be connected to the high voltage side power supply.

5. A constant voltage generation circuit according to claim 1, wherein said second circuit comprises a resistive element.

6. A constant voltage generation circuit according to claim 1, further comprising a feedback amplifier circuit for reducing fluctuations in the output voltage due to variations in power supply voltage.

7. A constant voltage generation circuit according to claim 1, further comprising a regulated cascade current mirror circuit for reducing dependence of the output voltage on power supply voltage.

8. A constant voltage generation circuit for generating a constant voltage free of the influence of temperature changes, comprising:

a first circuit for generating a current having a positive dependence on temperature changes; a second circuit for converting the current to a voltage, said first circuit and said second circuit being connected in parallel so that current passing through one of said first circuit and said second circuit is prevented from passing directly through the other of said first circuit and said second circuit; and means adapted for connecting the parallel combination of said first circuit and said second circuit between a high voltage side power supply and a low voltage side power supply to form a circuit for generating a voltage free of the influence of temperature changes.

9. A constant voltage generation circuit comprising:

a first bipolar transistor having a collector and a base connected to each other and an emitter adapted to be connected to a low voltage side power supply;

a second bipolar transistor having a base connected with the base of said first bipolar transistor;

a first resistive element adapted to be connected between an emitter of said second bipolar transistor and the low voltage side power supply;

a first MOS transistor having a drain connected to the collector of said first bipolar transistor and a source adapted to be connected to a high voltage side power supply;

a second MOS transistor having a gate connected with a gate of said first MOS transistor; a drain connected to a collector of said second bipolar transistor; and a source adapted to be connected to the high voltage side power supply;

a second resistive element connected with said first resistive element by way of a current mirror circuit to receive a current proportional to current flowing through said first resistive element; and a third bipolar transistor having a collector connected to a first end of said second resistive element and a base connected to a second end of said second resistive element, for generating at an emitter of said third bipolar transistor a constant voltage based on the power supply.

10. An emitter coupled logic output buffer circuit comprising:

a current switch formed by bipolar transistors;

an output bipolar transistor having a base connected to one output of said current switch, a collector adapted to be connected to a high voltage side power supply, and an emitter serving as a circuit output;

a voltage generation element adapted to be connected between the base of said output bipolar transistor and the high voltage side power supply, said voltage generation element generating a voltage having positive dependence on temperature changes by supplying to said voltage generating element a current having positive dependence on temperature changes, and outputting at the circuit output a signal free of dependence on temperature changes by cancelling the voltage having positive dependence with a base-to-emitter voltage of said output bipolar transistor having negative dependence on temperature changes; and a current source circuit for said current switch, including a circuit portion for generating a current having positive dependence on temperature changes which comprises a circuit connected with a current mirror circuit.

11. An emitter coupled logic output buffer circuit according to claim 10, wherein said circuit portion for generating a current having negative dependence on temperature changes comprises:

a first bipolar transistor having a collector and a base connected to each other and an emitter adapted to be connected to a low voltage side power supply;

a second bipolar transistor having a base connected to the base of said first bipolar transistor;

a resistive element adapted to be connected between an emitter of said second bipolar transistor and the low voltage side power supply;

a first MOS transistor having a drain connected to the collector of said first bipolar transistor and a source adapted to be connected to the high voltage side power supply; and a second MOS transistor having a gate connected to a gate of said first MOS transistor, a drain connected to a collector of said second bipolar transistors, and a source adapted to be connected to the high voltage side power supply.

12. An emitter coupled logic output buffer circuit according to claim 10, further comprising a feedback amplifier for generating a stable output signal free of dependence on power supply voltage changes.

13. An emitter coupled logic output buffer circuit according to claim 10, further comprising a regulated cascade current mirror circuit for generating a stable output signal free of dependence on power supply voltage changes.

14. An emitter coupled logic output buffer circuit according to claim 10, wherein said current mirror circuit comprises bipolar transistors.

15. An emitter coupled logic output buffer circuit according to claim 10, wherein said current mirror circuit comprises MOS transistors.

16. A semiconductor memory device comprising the constant voltage generation circuit according to claim 1.

17. A semiconductor memory device comprising the emitter coupled logic output buffer circuit according to claim 10.

18. A constant voltage generating circuit for generating a constant voltage free of the influence of temperature changes, comprising:

a band gap circuit, including two sets of PN junctions;

a first resistance element coupled across said two sets of PN junctions for passage through said first resistive element of a current resulting from the voltage across said two sets of PN junctions and proportional to absolute temperature;

a second resistance element;

means coupling said second resistance element for passage through said second resistance element of current proportional to the current through said first resistance element, while preventing current passing directly through one of said first resistance element and said second resistance element from passing through the other of said first resistance element and said second resistance element.

* * * * *